United States Patent [19]

Feinberg

[11] 4,294,226

[45] Oct. 13, 1981

[54] AUTOMATIC FURNACE VENT DAMPER CONTROL

[76] Inventor: Emanuel Feinberg, 24316 Martha Washington, Southfield, Mich. 48075

[21] Appl. No.: 113,992

[22] Filed: Jan. 21, 1980

[51] Int. Cl.[3] ..... F23L 3/00

[52] U.S. Cl. ..... 126/286; 126/290; 236/1 G; 236/93 A

[58] Field of Search ..... 126/285 R, 285 A, 292, 126/293, 286, 289, 290; 236/1 G, 93 R, 93 A, DIG. 11, 99 F, 99 G; 110/163

[56] References Cited

U.S. PATENT DOCUMENTS

| | | | |
|---|---|---|---|
| 1,784,608 | 12/1930 | Meyers | 236/93 R |
| 2,509,733 | 5/1950 | Gillen | 236/99 F |
| 2,712,731 | 7/1955 | Dills | 236/99 F |
| 4,071,190 | 1/1978 | Ford, Jr. | 236/93 A |

FOREIGN PATENT DOCUMENTS

| | | | |
|---|---|---|---|
| 261661 | 6/1913 | Fed. Rep. of Germany | 236/93 A |
| 486189 | 1/1976 | U.S.S.R. | 126/424 |

*Primary Examiner*—James C. Yeung
*Attorney, Agent, or Firm*—Krass, Young & Schivley

[57] ABSTRACT

A thermally actuated control system for the chimney flue or vent damper of a hot air furnace employs a fluid reservoir supported in the vent between the damper and the furnace so as to experience the furnace temperature, containing fluid that has a liquid state when the furnace is not in operation and a gaseous state at the higher temperature resulting when the furnace goes into operation. A spring biased piston movable within the reservoir is connected to the damper shaft by a barrel cam supported exteriorly of the vent, which converts the linear motion of the actuator into rotation of the damper shaft. The change in temperature when the furnace goes on or off produces a resultant change in the volume of the fluid within the reservoir, moving the linear actuator between its two positions and rotating the cam and the damper so that the damper is in an open position when the furnace is on and a closed position when the furnace is off.

9 Claims, 3 Drawing Figures

AUTOMATIC FURNACE VENT DAMPER CONTROL

BACKGROUND OF THE INVENTION

1. Field of the Invention

This invention relates to a thermally responsive control for a damper of the type used in the flue or vent of a burner such as a furnace to close the damper off when the furnace is not in operation and more particularly to such a damper control employing a fluid expansion chamber sensitive to vent temperature.

2. Prior Art

In a conventional furnace or boiler for heating a building, the combustion products heat a fluid transfer media such as air or water and then pass to the atmosphere through a chimney vent. When the furnace is not operating, heated air from within the building may be lost to the atmosphere by passage through the furnace air intake, through the combustion chamber, and up the vent. To prevent this heat loss and thus improve the operating efficiency of these devices, dampers are often employed in the vent to close off the chimney when the burner is not firing. One class of control systems for these dampers employs the same electrical signal which opens the fuel valve to the burner to open the damper. In the event that a control system of this type malfunctions, as by the fuel valve remaining jammed in an open position when it should be closed, the noxious combustion gases may back up into the heated building, endangering the occupants. To obviate this possibility, a class of dampers has been devised which sense the temperature in the furnace to detect furnace operation, and automatically open the damper whenever the temperature exceeds a predetermined value.

A number of these control systems have employed complex sensor systems or motor drive systems and have proven expensive and unreliable. Another class of devices is simpler and uses the motion of a bi-metal subjected to a changing temperature to control the motion of vent damper. These devices suffer from the corrosion that occurs because of the high temperatures that must be sensed as well as the corrosive atmosphere and many have proven unreliable in operation.

An alternative form of automatic thermal control system for burner dampers has heretofore been used to control the combustion air inlets to burners. These units employ the expansion of a gas subjected to burner combustion products to open an air damper. These devices are simple so as to be low in cost and reliable in operation but do not provide the relatively large motion required to move the vent damper from a full off to a full on position. For example, U.S. Pat. No. 136,291 discloses a damper supported in the air inlet passage of a furnace and controlled by an automatic apparatus including a fluid reservoir disposed in the combustion chamber and connected by a tube to a chamber formed on one side of a diaphragm. Motion of the diaphragm, resulting from a change in the pressure in the reservoir, controls the position of the damper as a function of the furnace temperature to regulate the air in-flow to the furnace. While this form of proportional damper regulation is simple and reliable in operation, its principle is not applicable to the problem of vent damper control wherein the damper must be moved between a full open and a full closed position each time the burner goes on or off.

SUMMARY OF THE INVENTION

The present invention is directed toward a thermally responsive vent damper control system employing a change in volume of a fluid to move the damper to a closed position when the burner goes off and to an open position when the burner turns on. The damper employs relatively few moving parts so as to be low in cost and reliable in operation.

In a preferred embodiment of the invention, which will subsequently be described in detail, the system employs a planar damper rotatably supported on a shaft extending transversely to the longitudinal axis of the vent so that a 90° rotation of the shaft moves the damper between the position in which the damper plane is transverse to the longitudinal axis of the vent, and effectively closes off the vent and a position in which the damper plane is aligned with the longitudinal axis of the vent to allow passage of gases through the vent. The damper shaft extends through the vent wall and a barrel cam having a spiral groove in its outer perimeter is attached to the end of the shaft.

The damper is positioned, through the cam, by a linear actuator having one end attached to a cam follower that moves in the spiral cam track. Motion of the actuator parallel to the axis of the cam is converted into rotation of the damper shaft. The linear actuator is moved by a sealed bellows that responds to the changes in volume of a fluid subjected to the heat of combustion gases passing through the vent. The fluid is preferably liquid at the vent temperature that results when the burner is off and changes to a gas at vent temperatures associated with operation of the furnace. The large change in volume of the fluid between its liquid and gaseous states cause motion of the bellows and resulting motion of the linear actuator. The bellows is preferably supported within a fluid reservoir disposed within the vent. The fluid may be contained either in the reservoir, in which case the volume of the fluid causes the sealed bellows to contract, or within the bellows itself, in which case the increase in volume causes the bellows to expand. The chamber, or bellows, may be evacuated so that a pressure below atmospheric pressure is exerted on the fluid when the burner is off. This reduces the boiling temperature of the fluid to a level consistent with the reservoir temperature when the burner is operating.

Supporting the bellows within the reservoir removes it from contact with the corrosive flue gases, allowing the use of a lightweight and highly sensitive bellows.

The automatic damper actuator system of the present invention is therefore highly reliable in operation, independent of proper operation of the electric thermostat system or the electric fuel valve, and simple in construction so as to be low in cost.

Other objectives, advantages and applications of the present invention will be made apparent by the following detailed description of two preferred embodiments of the invention. The description makes reference to the accompanying drawings in which.

Figure 1:
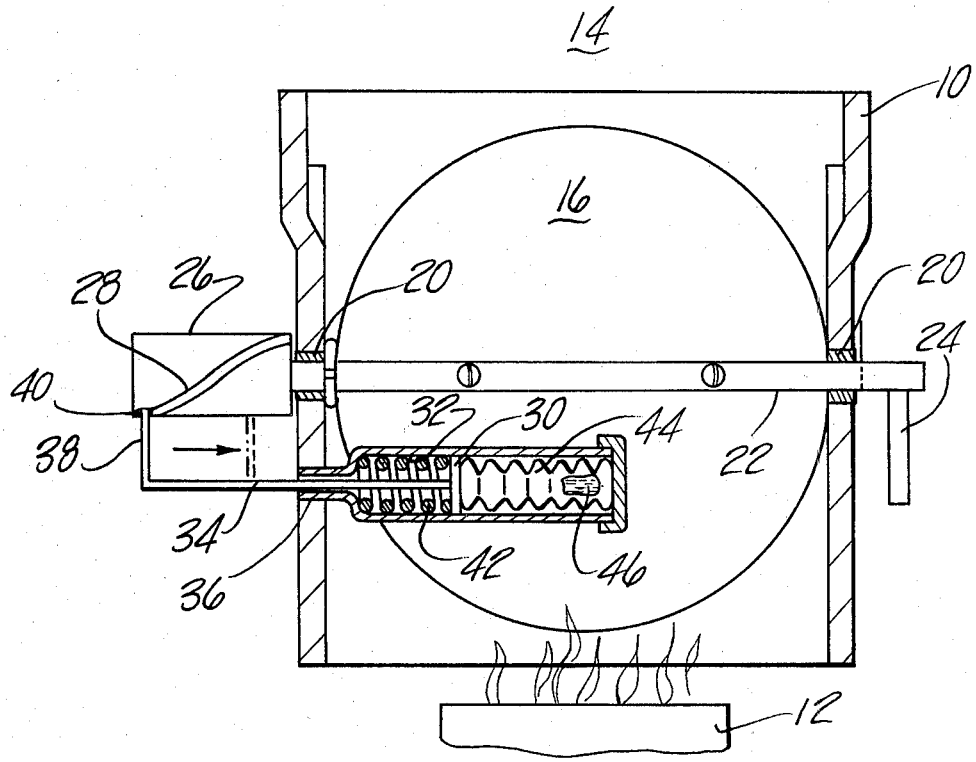
FIG. 1 is an elevation view of a furnace chimney vent, partly sectioned and partly broken away for purposes of illustration, incorporating an automatic vent damper control system comprising a preferred embodiment of the present invention.

Referring to FIG. 1, a preferred embodiment of the present invention is employed in connection with a cylindrical section of chimney vent 10 extending between a schematically illustrated burner 12 and the atmosphere 14. The vent damper section 10 is shown in section for purposes of more comprehensive disclosure.

A disc-shaped planar damper blade 16 is supported within the vent section 10 on an elongated shaft 22 that extends transversely across the vent and is journalled in a pair of sleeve bearings 20, supported at diametrically opposed points on the vent cylinder 10. Shaft 22 is fixed to the damper 16 along a diametric line so that in one rotational position of the shaft 22 the damper blade 16 extends transversely across the vent 10, substantially closing it off against the passage of gases, and when the shaft 22 is rotated through 90° the damper blade 16 moves into a position longitudinally aligned with the axis of the vent 10 so that combustion gases from the burner 12 may freely flow through the vent to the atmosphere 14.

One end 22 of the damper shaft extends beyond the cylinder walls 10 of the vent and carries a laterally extending indicating pointer 24. The pointer is aligned on the shaft 22 with the damper blade 16 so as to allow determination of the damper position from the exterior of the vent.

The other end of the shaft 22 extends beyond its support bearing 20 and connects to a barrel cam 26 positioned on the exterior of the vent. The shaft is connected to the cam so as to form an extension of its central axis. A spiral cam track 28 is formed on the outer perimeter of the cam.

The cam may be rotated by a linear actuator incorporating a piston 30 that is slideably movable linearly within an elongated cylinder 32. The piston 30 has a rod 34 connected to one of its ends and extending along the central axis of the cylinder 32. The rod passes through a central cap 36 formed in one end of the cylinder and retained in an opening in the damper housing wall. A laterally extending pin 38 is attached to the end of the rod 34 on the exterior of the vent. A cam follower 40 is secured to the far end of the pin 38 and rides in the spiral track 28 formed on the cam 26. Longitudinal motion of the piston 30 along the cylinder 32 thus moves the follower 40 parallel to the central axis of the cam 26 and causes rotation of the cam 26 and resultant rotation of the damper shaft 22.

The piston 30 is biased toward motion along the cylinder 32 in the direction of the end opposite the cap 36 by a coil spring 42 that is wound about the rod, within the cylinder and bears against one side of the piston and the internal side of the end cap 36. A cylindrical copper bellows 44 is supported within the cylinder 32 on the opposite side of piston 30 from the spring 34. The bellows is sealed and contains a fluid 46. The fluid 46 is preferably water but alternatively other fluids having desirable boiling points and temperature-volume characteristics could be employed, such as various alcohols or the like. Alternatively, the fluid could have a boiling point above the maximum temperature reached in the bellows but a high coefficient of thermal expansion in the liquid phase.

FIG. 1 illustrates the bellows 44 as being fully expanded, as it is when the burner 12 has attained its full operating temperature. Piston 30 is therefore at one extreme of its range of motion, illustrated as being to the left in FIG. 1, and the spring 42 is fully compressed. In this position the damper blade 16 is aligned with the longitudinal axis of the flue 10, allowing free flow of flue gases to the atmosphere.

Figure 2:
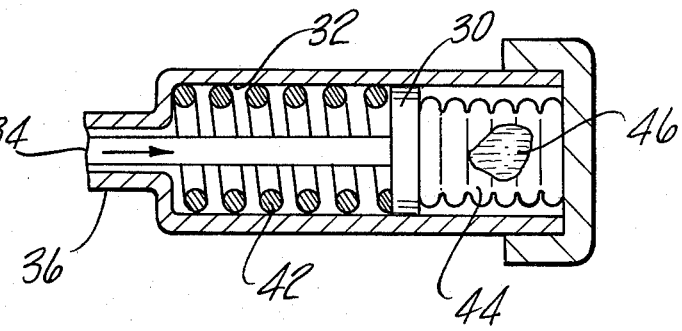
FIG. 2 is a detail elevation view of the fluid cylinder employed with the embodiment of FIG. 1.

When the burner 12 is de-energized the cylinder 34 will begin to cool and accordingly the temperature within the bellows 44 will begin to decrease. Fluid contained within the bellows 44 will begin to contract and the resulting pressure differential between the interior of the bellows, and the volume within the cylinder 32 surrounding the bellows, which latter volume is connected to atmosphere through the end cap 36, will cause the bellows to contract. This contraction will move the piston 30 and its rod 34 to the right as illustrated in FIGS. 1 and 2, the cam follower will force the cam 26 to rotate, bringing the damper blade 16 into a position in which it extends transversely across the flue 10 and effectively prevents the escape of heated gases from the furnace, and from the building, through the chimney. The spring will accelerate the contraction of the bellows and assure positive closing.

FIG. 2 illustrates the bellows 44 in its fully contracted position with the damper blade 16 aligned normally to the central axis of the vent 10. This position is obtained before the bellows 44 has fully cooled to the temperature within the building. For example, considering the normal temperature within the building to be 20° C. and the furnace flue to attain a temperature of 150° C. when the furnace is in full operation, the bellows may become fully contracted at a temperature of 80° C. As the bellows continues to cool the fluid within the bellows continues to contract, creating a pressure differential between the interior of the bellows and its exterior. As the temperature continues to lower through the boiling point of the fluid 46 at the reduced pressure within the bellows, the fluid liquifies, substantially decreasing in volume.

The partial vacuum that exists within the bellows when the cylinder 34 has cooled to building temperature allows the fluid 46 to undergo an abrupt change of volume at a predetermined temperature point as the cylinder temperature goes through its excursion between full furnace temperature and ambient temperature. For example, assuming the fluid 46 is water, initial pressure within the bellows may be controlled so that the water boils when the bellows attain a temperature of 80° C. because of the partial vacuum within the bellows at that time. The resultant large increase in the fluid volume causes relatively rapid motion of the piston 30 and a relatively rapid shift of the damper position between its open and closed positions.

Figure 3:
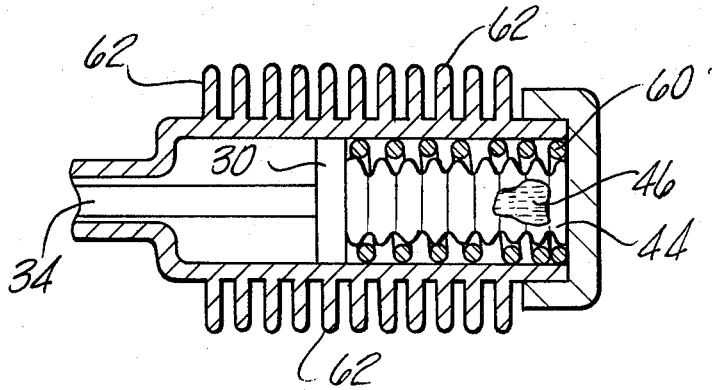
FIG. 3 is a section through a fluid cylinder formed in accordance with another alternative embodiment of the present invention.

A slightly modified embodiment of the automatic damper control system is illustrated in FIG. 3. Most of the components are identical with those illustrated in FIGS. 1 and 2 and the same reference numerals are employed. This embodiment differs from the embodiment of FIGS. 1 and 2 in that the biasing spring 32 employed in the embodiment of FIGS. 1 and 2 is replaced by a biasing spring 60 positioned to the right of the piston 30 as viewed in FIG. 3 so as to bias the piston toward its left-most position, in which the damper blade 16 is open. This arrangement is advantageous in that a failure of the bellows will cause the damper to move to its open or safe position. The cylinder 32 is also provided with a series of radial fins 62 which enhance its heat transfer with the gases in the fluid damper.

In alternative embodiments of the invention the rapid and extensive motion of the bellows as the furnace turns on and off could be coupled to the damper by other linearrotary mechanisms such as a rack and gear or a worm gear driving opposed gears.

The embodiments of the invention in which an exclusive property or privilege is claimed are defined as follows:

1. A temperature responsive damper system for use with a burner having a vent for combustion gases, comprising: a rotatable damper shaft supported in the vent to extend transversely across the vent; a planar damper fixed to the shaft so as to extend in a closed position transversely to the vent and block passage of air through the vent when the shaft is in a first rotational position and to extend in an open position parallel to the longitudinal axis of the vent to allow gas passage through the vent when the shaft is in a second rotational position; a fluid reservoir supported in the vent between the damper and the burner so that the reservoir experiences a temperature which depends upon the state of operation of the burner; a fluid contained in the reservoir having a liquid state when the reservoir temperature is that obtained when the burner is not in operation and a gaseous state when the reservoir temperature is that obtained when the burner is in operation; a linear actuator supported for movement between a first position and a second position; a cam mechanism fixed to the damper shaft and connected to the linear actuator so that the damper is in an open position when said actuator is in a first position and the damper is in a closed position when the actuator is in the second position; and means for moving the actuator from its first position to the second position upon transition of the fluid within the reservoir from a liquid to a gas as a result of an increase in temperature in the reservoir resulting from the burner going into operation, and from its second position to its first position upon transition of the fluid from a gas to a liquid as a result of a decrease in the temperature of the reservoir resulting from the burner going out of operation; whereby said damper assumes its open position when the burner is in operation and its closed position when the burner is not in operation.

2. The normally actuated damper system of claim 1 wherein the fluid reservoir is sealed with respect to the atmosphere and pressure within the reservoir is below atmospheric pressure.

3. The thermally actuated damper of claim 1 in which said means for moving the linear actuator from its first position to its second position includes a sealed, expandable bellows supported within the reservoir.

4. The thermally actuated damper system of claim 1 in which said cam means includes a rotatable barrel cam having a spiral groove on its periphery, the barrel cam being fixed to the damper shaft so that the damper shaft is rotated with the barrel cam, and a cam follower supported in the spiral groove and fixed to the linear actuator so that motion of the linear actuator moves the follower along the longitudinal axis of the cam, causing rotation of the cam and of the damper.

5. The thermally actuated damper system of claim 1 including means for biasing the linear actuator toward one position.

6. A thermally actuated damper system for a burner having a chimney vent, comprising: a damper supported in the vent for motion between an open position in which the passage of gases through the vent is allowed and a closed position in which the passage of gases through the vent is blocked; a fluid reservoir supported in the vent between the damper and the burner so that the reservoir experiences a temperature dependent upon the state of operation of the burner; fluid disposed in the reservoir of such nature as to have a liquid state when the reservoir temperature is that obtained when the burner not in operation and a gaseous state when the temperature of the reservoir is that obtained when the burner is in operation; a linear actuator supported for motion between first and second positions; a cam mechanism interconnecting the actuator to the damper so that the damper is in its open position when the actuator is in its first position and the damper is in its closed position when the actuator is in its second position; spring means for biasing the actuator to its first position; and means energized by the expansion of the fluid volume as it changes from a liquid state to a gaseous state for moving the actuator from its first position to its second position, against said spring bias, upon the reservoir experiencing an increase in temperature from that produced when the burner goes into operation, whereby the damper is normally biased towards an open position and moves to its closed position when the furnace is off.

7. The thermally actuated burner damper system of claim 6 in which said cam mechanism interconnected between the linear actuator and the damper comprises a barrel cam, having a spiral groove formed on its periphery connected to the damper shaft and a cam follower supported in said cam groove and connected to the linear actuator, so that motion of the cam follower produced by motion of the actuator causes rotation of the damper.

8. The thermally actuated damper system of claim 7 in which said cam is supported exteriorly of said vent.

9. The thermally actuated damper system of claim 6 wherein said means actuated by the expansion of the fluid volume constitutes a sealed bellows supported in the reservoir.

* * * * *